US010054303B2

(12) United States Patent
Zheng et al.

(10) Patent No.: US 10,054,303 B2
(45) Date of Patent: Aug. 21, 2018

(54) ASSEMBLE MECHANISM OF LED LAMP AND DISASSEMBLING METHOD THEREOF

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Zhaoyong Zheng, Zhejiang (CN); Huangfeng Pan, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 4 days.

(21) Appl. No.: 15/624,050

(22) Filed: Jun. 15, 2017

(65) Prior Publication Data

US 2017/0370567 A1 Dec. 28, 2017

(30) Foreign Application Priority Data

Jun. 22, 2016 (CN) ..... 2016 1 0473508

(51) Int. Cl.

| | |
|---|---|
| ***F21V 23/06*** | (2006.01) |
| ***F21V 3/00*** | (2015.01) |
| ***F21V 5/04*** | (2006.01) |
| ***F21V 29/89*** | (2015.01) |
| ***F21V 21/005*** | (2006.01) |
| ***F21S 4/28*** | (2016.01) |
| *F21Y 115/10* | (2016.01) |
| *F21S 2/00* | (2016.01) |

(Continued)

(52) U.S. Cl.

CPC ..... *F21V 23/06* (2013.01); *F21S 4/28* (2016.01); *F21V 3/00* (2013.01); *F21V 5/04* (2013.01); *F21V 21/005* (2013.01); *F21V 29/89* (2015.01); *F21S 2/00* (2013.01); *F21V 15/015* (2013.01); *F21Y 2103/10* (2016.08); *F21Y 2115/10* (2016.08)

(58) Field of Classification Search

CPC ..... F21V 23/06; F21V 21/005; F21V 29/89; F21V 3/00; F21V 5/04; F21V 15/015; F21S 4/28; F21S 2/00; F21Y 2103/10; F21Y 2115/10

See application file for complete search history.

(56) References Cited

U.S. PATENT DOCUMENTS

2012/0250302 A1* 10/2012 Edwards ..... F21V 31/005 362/223
2015/0316238 A1* 11/2015 Guilmette ..... H01R 25/14 362/218
2017/0373483 A1* 12/2017 Chen ..... H02G 15/013

* cited by examiner

*Primary Examiner* — Kevin Quarterman
(74) *Attorney, Agent, or Firm* — Wang Law Firm, Inc.

(57) ABSTRACT

An assemble mechanism of LED lamp and a disassembling method, the assemble mechanism of LED lamp includes strip houses, covers, and coupling assembly. The coupling assembly includes a plug, and a socket. The plug includes a plug-body, and a T-shaped head. The T-shaped head includes a straight bar, and a horizontal bar. The straight bar provides two wedge structures on two side walls respectively. The socket includes a socket body, and a T-shaped cavity configured for receiving the T-shaped head. The T-shaped cavity provides two catches on the two inner side walls, the two catches is configured for clamping the two wedge structures. As long as the plug of the coupling assembly is engaged with the socket, and the wedge structure is clamping into the catch, which makes interconnection of the two LED lamps simple and convenient, and helps to reduce the installation time.

6 Claims, 3 Drawing Sheets

(51) Int. Cl.

| | |
|---|---|
| *F21V 15/015* | (2006.01) |
| *F21Y 103/10* | (2016.01) |

ASSEMBLE MECHANISM OF LED LAMP AND DISASSEMBLING METHOD THEREOF

RELATED APPLICATION

This present application claims benefit of the Chinese Application, CN201610473508.2, filed on Jun. 22, 2016.

BACKGROUND

1. Technical Field

The present application relates to lighting equipments, and more particularly to an assemble mechanism of LED lamp and a disassembling method thereof.

2. Description of the Related Art

Light emitting diode (LED) is growing in popularity due to decreasing costs and long life compared to incandescent lighting and fluorescent lighting. Recently, a number of LED lighting apparatuses have been designed to replace the halogen apparatus, as well as other traditional incandescent or fluorescence lighting apparatuses. In some places such as exhibition halls, jewelry stores, museums, supermarkets, and some home lighting, such as large villas, will use a lot of strip LED lamps. However, due to the structural characteristics of the strip lamp itself, that is, the bar structure, and because the size of the used bar lamp is uncertain, the bar lights of different lengths need to be connected together when the strip lamps are installed Installation. Therefore installation convenience of these different lengths or the same length of the strip lamps will be one of the main design guidelines thereof. On the other hand, when these strip lamps which have different lengths may need to be replaced as one or a few of them are not work, all of the installed strip lamps need to be disassembled because single thereof cannot be disassembled down. As a result, it will waste working hours and increase costs.

Therefore, it is necessary to provide an assemble mechanism of LED lamp and a disassembling method thereof which makes it possible to rapidly install the strip lamps.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
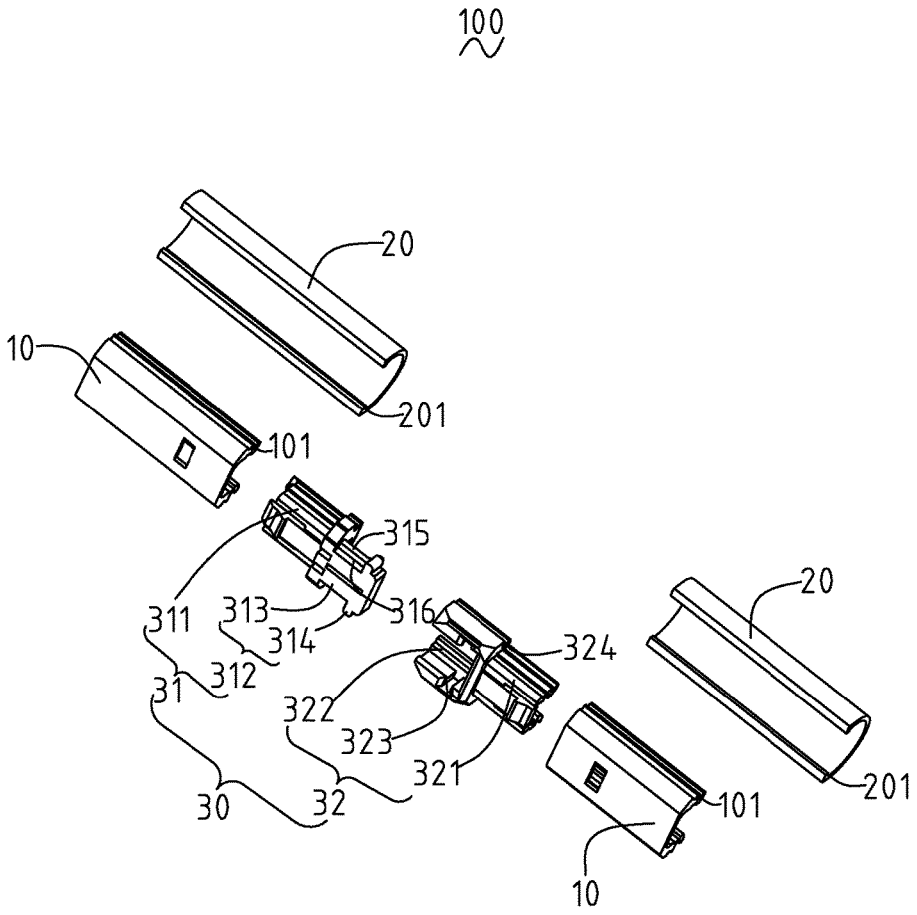
FIG. 1 is an explored view of an assemble mechanism of LED lamp according to an embodiment.

Referring to FIG. 1, an explored view of an assemble mechanism 100 of LED lamp is shown. The assemble mechanism 100 of LED lamp includes at least two strip houses 10, at least two covers 20 arranged onto the two strip houses 10 respectively, and at least one coupling assembly 30. As is well known, the LED lamp may include other modules, such as lens module, LED chips, PCB module (not shown), and so on. These lens module, LED chips and PCB module can be mounted into the two strip houses 10 and the two covers 20 are covered onto the two strip houses 10 respectively. Therefore, two rounded LED lamps are completed.

Each of the strip houses 10 includes a U-shaped groove 101. The U-shaped groove 101 is configured for receiving the lens module, the LED chips, and the PCB module. Two slots 102 are opened on the two side walls of each of the strip houses 10 respectively. The slots 102 are configured to mount the cover 20. The strip houses 10 may be made of metal, such as aluminum alloy. The strip houses 10, which are made of metal, can not only ensure the strength of the LED lamp but also increase the heat dissipation efficiency.

Each of the covers 20 may be made of a plastic or resin material having a certain light transmittance. In the present embodiment, the covers 20 are made of plastic having a light transmittance of less than 1 in order to prevent glare. Each of the covers 20 includes two bar-typed pins 201 extending from inner wall thereof. The two bar-typed pins 201 are inserted into the two slots 101 respectively so as to fix the cover 20 onto the strip houses 10.

Figure 2:
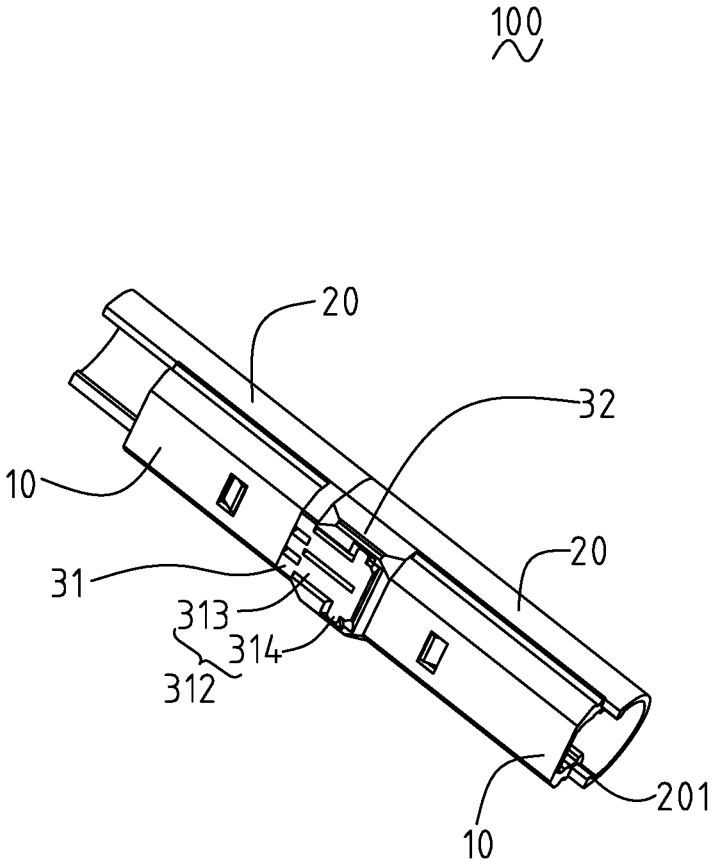
FIG. 2 is an isometric view of the assemble mechanism of LED lamp of FIG. 1.

The coupling assembly 30 includes a plug 31 disposed at one end of one of the strip houses 10 and a socket 32 disposed at the other end of the strip houses 10 and connected to the plug 31. During installation, the plug 31 of one of the strip houses 10 is usually coupled into the socket 32 of the other of the strip houses 10 so that two LED lamps can be connected together. It is to be noted that, for the purpose of the interconnection between two or more LED lamps, each of the LED lamps have one plug 31 and one socket 32 respectively, which is formed into an independent and whole lamp. The plug 31 includes a plug-body 311 fixed in the U-shaped groove of the strip houses 10, and a T-shaped head 312 extending from the plug-body 311. The method of connecting the plug-body 311 to the strip house 10 may be a variety of ways, such as welding, clamping, and so on. In the present embodiment, the plug-body 311 is inserted into the U-shaped groove of the strip house 10 and fixed therein via the method of clamping. The T-shaped head 312 is integrally formed with the plug-body 311 and includes a straight bar 313 connected to the plug-body 311 and a horizontal bar 314 extending from the side walls of the straight bar 313 so as to form the T-shaped head 312. Each of the two side walls of the straight bar 313 are provided with a wedge structure 315, respectively, which will be described later in detail. A step 316 is formed between the wedge structure 315 and the straight bar 313. As shown in FIG. 2, a thickness of the wedge structure 315 is less than that of the straight bar 313, thereby forming the step 316. The step 316 will be further described later.

The socket 32 includes a socket-body 321 secured in the strip house 10, a T-shaped cavity 322 extending along the socket-body 321 for receiving the T-shaped head 312. The socket-body 321 is similar to the plug-body 311 and the connection method with the strip house 10 may be various, such as welding, clamping, or the like. In the present embodiment, the socket-body 321 is inserted into the U-shaped groove 101 of the strip house 10 and is fixed therein by means of clamping. The inner side walls of the T-shaped cavity 322 are provided respectively a catch 323 for engaging with the wedge structure 315. The T-shaped cavity 322 is also integrally formed with the socked-body 321. When the wedge structure 315 of the T-shaped head 312 is inserted into the T-shaped cavity 322, the catch 323 may engage with the step 316 of the T-shaped head 312 so as to fix the plug 31 and socket 32. And when the T-shaped head 312 is inserted into the T-shaped cavity 322, it is accomplished by the inherent plasticity of the material produced by the T-shaped cavity 322. That is to say, when the T-shaped head 312 is inserted therein, the T-shaped cavity 322 becomes larger, and after insertion the T-shaped cavity 322 is automatically restored to its original shape. The two outer side walls of the T-shaped cavity 322 are provided respectively with a socket slot 324. When the plug 31 is inserted into the socket 32, the cover 20 can be pushed into the socket slot 324 of the T-shaped cavity 322 and covers onto the T-shaped cavity 322 so that the two covers 20 of the two LED lamps 100 are connected seamlessly.

It can be understood that when two LED lamps 100 are connected together via the coupling assembly 30, it is necessary to achieve an electrical connection. Therefore, it is also possible to provide an elastic chip and tap in the plug 31 and socket 32 respectively. When the T-shaped head 312 is inserted into the T-shaped cavity 322, the elastic chip is electrically connected to the tap thereby enabling the circuit to turn on and further enabling the two LED lamps 100 in series. However, the above-described technique is well known in the prior art, and therefore, the present invention is not described in detail.

During installation, only the T-shaped cavity 322 of the socket 32 is directly engaged with the T-shaped head 312 of the plug 31 by means of the ductility of the material of the coupling assembly 30, and the cover 20 is pushed into the socket slot 324 of the socket 32. Thereby, the installation of the LED lamps 100 is completed.

Figure 3:
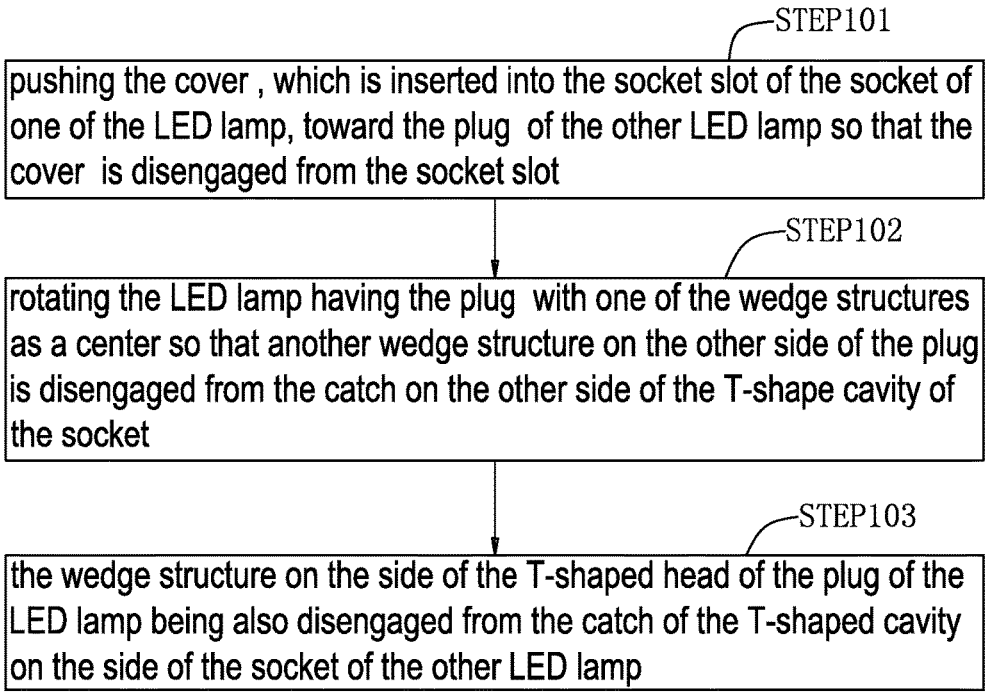
FIG. 3 is a flow diagram of the disassembling method of the assemble mechanism of the LED lamp of FIG. 1

As shown in FIG. 3, a disassembling method of the LED lamp having the above assemble mechanism 100 is presented:

STEP101: pushing the cover 20, which is inserted into the socket slot 324 of the socket 32 of one of the LED lamp, toward the plug 31 of the other LED lamp so that the cover 20 is disengaged from the socket slot 324;

STEP102: rotating the LED lamp having the plug 31 with one of the wedge structures 315 as a center so that another wedge structure 315 on the other side of the plug 31 is disengaged from the catch 324 on the other side of the T-shape cavity 322 of the socket 32.

STEP103: the wedge structure 315 on the side of the T-shaped head 312 of the plug 31 of the LED lamp is also disengaged from the catch 324 of the T-shaped cavity 322 on the side of the socket 32 of the other LED strip lamp.

As described above, the interconnection structure and the interconnection method of the assemble mechanism 100 of the LED lamp of the present invention are simple and convenient as long as the plug 31 of the coupling assembly 30 is engaged with the socket 32, and the wedge structure 315 is clamping into the catch 324, which makes interconnection of the two LED lamps simple and convenient, and helps to reduce the installation time. Moreover, due to the above-described assemble mechanism, it is possible to disassemble a single lamp without operating the other lamps, thereby reducing disassembling hours and reducing the cost.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An assemble mechanism of LED lamp, comprising:

at least two strip houses (10), each of the strip houses (10) having a U-shaped groove (101) and two slots (102) opened two side walls thereof respectively;

at least two covers (20), the two covers (20) being arranged onto the two strip houses (10) respectively, each of the covers (20) comprising two bar-typed pins (201), the two bar-typed pins (201) being inserted into the two slots (102) respectively; and at least one coupling assembly (30), the coupling assembly (30) being configured for connecting two strip houses (10) together, the coupling assembly (30) comprising a plug (31) disposed at one end of one of the strip houses (10) and a socket (32) disposed at the other end of the strip houses (10) and connected to the plug (31), the plug (31) comprising a plug-body (311) fixed on the strip houses (10), and a T-shaped head (312) extending from the plug-body (311), the T-shaped head (312) comprising a straight bar (313) connected to the plug-body (311), a horizontal bar (314) extending from the side walls of the straight bar (313), and two wedge structures (315) provided on two side walls of the straight bar (313) respectively, the socket (32) comprising a socket body (321) fixed on the strip houses (10), and a T-shaped cavity (322) extending from the socket body (10) configured for receiving the T-shaped head (312), and two catches (323) provided on two inner side walls of the T-shaped cavity (322) respectively and configured for clamping the wedge structures (315).

2. The assemble mechanism of LED lamp as claimed in claim 1, wherein the T-shaped cavity (322) comprises two socket slots (324) provided respectively on two side walls thereof, the two socket slots (324) are configured for engaging with the two bar-typed pins (201) of the cover (20), respectively.

3. The assemble mechanism of LED lamp as claimed in claim 2, wherein the cover (20), which is inserted in the socket slot (324), is a cover which is arranged on the strip house (10) on which the plug (31) is located.

4. The assemble mechanism of LED lamp as claimed in claim 1, wherein the coupling assembly (30) is made of plastic.

5. The assemble mechanism of LED lamp as claimed in claim 1, wherein two steps (316) are formed between the wedge structure (315) and the straight bar (313), the two catches (323) are engaged on the two steps (316) respectively.

6. A disassembling method of the assemble mechanism of LED lamp as claimed in claim 1 comprising the following steps:

pushing the cover (20), which is inserted into the socket slot (324) of the socket (32) of one of the LED lamp, toward the plug (31) of the other LED lamp so that the cover (20) is disengaged from the socket slot (324);

rotating the LED lamp having the plug (31) with one of the wedge structures (315) as a center so that another wedge structure (315) on the other side of the plug (31) is disengaged from the catch (323) on the other side of the T-shape cavity (322) of the socket (32); and the wedge structure (315) on the side of the T-shaped head (312) of the plug (31) of the LED lamp being also disengaged from the catch (323) of the T-shaped cavity (322) on the side of the socket (32) of the other LED lamp.

* * * * *